United States Patent [19]

Vermeulen et al.

[11] Patent Number: 5,004,659

[45] Date of Patent: Apr. 2, 1991

[54] DYE IMAGE RECEIVING MATERIAL

[75] Inventors: Leon L. Vermeulen, Herenthout; Robert S. Pauwels, Brasschaat; Willy P. De Smedt, Mechelen; Ludovicus H. Vervloet, Kessel, all of Belgium

[73] Assignee: Agfa-Gevaert, N.V., Mortsel, Belgium

[21] Appl. No.: 495,159

[22] Filed: Mar. 19, 1990

[30] Foreign Application Priority Data

Mar. 20, 1989 [EP] European Pat. Off. ... EP89200708.9

[51] Int. Cl.[5] ..... G03C 5/54

[52] U.S. Cl. ..... 430/14; 430/213; 430/941

[58] Field of Search ..... 430/212, 213, 518, 941, 430/14; 101/464

[56] References Cited

U.S. PATENT DOCUMENTS 4,186,014 1/1980 Bergthaller et al. ..... 430/213

4,762,759 8/1988 Vermeulen et al. ..... 430/14

4,902,593 2/1990 Vermeulen et al. ..... 430/213

*Primary Examiner*—Richard L. Schilling

*Attorney, Agent, or Firm*—Breiner & Breiner

[57] ABSTRACT

An image receiving material suitable for image production by dye diffusion transfer processing controlled by the development of (an) image-wise exposed silver halide emulsion layer(s), wherein said image receiving material comprises a supported image receiving layer free from gelatin and containing (1) a cationic polymeric mordant, and (2) colloidal silica applied from an aqueous acidic colloidal sol having a pH of not more than 4, and containing hydrated silica in combination with a smaller amount of colloidal alumina, the amount of said colloidal material to said mordant in the image-receiving layer being in a weight ratio range from 1/5 to ½, and silica ($SiO_2$) being present at a coverage of at least 0.5 g per m2.

11 Claims, No Drawings

DYE IMAGE RECEIVING MATERIAL

DESCRIPTION

The present invention relates to a material containing an image receiving layer suitable for carrying out a dye diffusion transfer processing controlled by the development of a photo-exposed silver halide emulsion layer.

The use of image receiving materials in the silver complex diffusion transfer reversal (DTR-) process is well known state of the art.

A more recently developed diffusion transfer reversal process is based on the image-wise transfer of diffusible dye molecules from an image-wise exposed silver halide emulsion material into a waterpermeable image receiving layer containing a mordant for the dye(s). The image-wise diffusion of the dye(s) is controlled by the development of one or more image-wise exposed silver halide emulsion layers, that for the production of a multicolour image are differently spectrally sensitized and contain respectively a yellow, magenta and cyan dye molecules. A survey of dye diffusion transfer imaging processes has been given by Christian C. Van de Sande in Angew. Chem. - Ed. Engl. 22 (1983) n° 3, 191-209.

For use in dye diffusion transfer photography the type of mordant chosen will depend upon the dye to be mordanted. If acid dyes are to be mordanted, the image-receiving layer contains basic polymeric mordants such as polymers of amino-guanidine derivatives of vinyl methyl ketone such as described in U.S. Pat. No. 2,882,156, and basic polymeric mordants and derivatives, e.g. poly-4-vinylpyridine, the metho-p-toluene sulphonate of 2-vinylpyridine and similar compounds described in U.S. Pat. No. 2,484,430, and the compounds described in the published DE-A 2,009,498 and 2,200,063. Other mordants are long-chain quaternary ammonium or phosphonium compounds of ternary sulphonium compounds, e.g. those described in U.S. Pat. Nos. 3,271,147 and 3,271,148, and cetyltrimethylammonium bromide. Certain metal salts and their hydroxides that form sparingly soluble compounds with the acid dyes may be used too. The dye mordants are dispersed or molecularly divided in one of the usual hydrophilic binders in the image-receiving layer, e.g. in gelatin, polyvinyl alcohol, polyvinylpyrrolidone or partly or completely hydrolysed cellulose esters.

In U.S. Pat. No. 4,186,014 cationic polymeric mordants are described that are particularly suited for fixing anionic dyes, e.g. sulphinic acid salt dyes that are image-wise released by a redox-reaction described in U.S. Pat. No. 4,232,107.

Said cationic polymeric mordants contain glycidyl groups that can react with active hydrogen atoms being present in gelatin serving as binding agent. Such polymers can be made by quaternizing a basic polyurethane, polyurea or polyurea-polyurethane with a quaternizing agent capable of introducing glycidyl groups.

The mordant layer contains preferably said cationic polymeric mordant in quantities of from 10 to 70% by weight based on the total solids content of the mordant layer. An image receiving layer on the basis of said mordant is applied to polyester resin supports.

When as support for the above composed image receiving layer a support of a vinyl chloride polymer is used, that is preferred for use in the production of laminates by heat sealing, there is a problem with the adherence of said receiving layer to the support. The dye image receiving layer on a vinyl chloride support must remain securely anchored thereto in dry as well as in wet conditions. Such is particularly important when vinyl chloride supports are used in the production of tamperproof identification cards.

In accordance with the invention described in U.S. Pat. No. 4,772,536 an image receiving material suitable for image production by dye diffusion transfer processing controlled by the development of (an) image-wise exposed silver halide emulsion layer(s) is provided, wherein the support of said material is substantially consisting of a vinyl chloride polymer and the support is coated with an image receiving layer containing gelatin in admixture with a cationic polymeric mordant containing glycidyl groups that can react with active hydrogen atoms of the gelatin, the weight ratio of said polymeric mordant to gelatin being from 25:1 to 2.5:1, preferably being 5:1, and the gelatin being present at a coverage of at least 0.1 g per m2.

Although gelatin is one of the most common hydrophilic colloid binding agents for forming waterpermeable coatings in which photographic ingredients can diffuse easily it has some disadvantages in the preparation of such coatings because its dissolving or transformation in sol state is preceded by a rather time consuming swelling in water mostly at elevated temperature.

Moreover, gelatin containing coatings require the use of a subbing layer to adhere properly to a hydrophobic resin support such as a vinyl chloride resin support and therefore it would be very advantageous if such subbing layer could be omitted.

It is an object of the present invention to provide an image receiving material containing a supported waterpermeable image receiving layer suitable for carrying out a dye diffusion transfer processing controlled by the development of a photo-exposed silver halide emulsion layer wherein said image receiving layer is free from gelatin and contains a mordant for fixing dyes transferred by diffusion.

It is another object of the present invention to provide an image receiving material containing a supported waterpermeable image receiving layer suitable for carrying out a dye diffusion transfer processing controlled by the development of a photo-exposed silver halide emulsion layer wherein said image receiving layer containing a mordant and being free from gelatin is coated directly onto a hydrophobic resin support, e.g. polyvinyl chloride resin support and adheres thereto very well in dry as well as in wet state.

It is an other object of the present invention to use said image receiving material in the production of heat- and pressure sealed laminates that may serve as identification document.

Other objects and advantages of the present invention will appear from the following description.

In accordance with the present invention an image receiving material suitable for image production by dye diffusion transfer processing controlled by the development of (an) image-wise exposed silver halide emulsion layer(s) is provided, wherein said image receiving material comprises a supported image receiving layer free from gelatin and containing (1) a cationic polymeric mordant, and (2) colloidal silica applied from an aqueous acidic colloidal sol having a pH of not more than 4, and containing hydrated silica in combination with a smaller amount of colloidal alumina, the amount of said colloidal material to said mordant in the image-receiving layer being in a weight ratio range from 1/5 to ½, and silica ($SiO_2$) being present at a coverage of at least 0.5 g per m2.

The above mentioned acidic sol can be prepared by addition of aluminium trihalide, preferably aluminium trichloride, to a basic aqueous colloidal silica sol producing that way in situ colloidal alumina forming an intimate mixture with the colloidal silica, e.g. in an amount from 5 to to 15% by weight of $Al_2O_3$ with respect to $SiO_2$.

According to a preferred embodiment the colloidal silica has a surface area of at least 100 m2 per gram, more preferably in the range of 200 to 300 m2 per gram.

The surface area of the colloidal silica is determined acording to the method described by Nelsen and Eggertsen in "Determination of Surface Area Adsorption Measurements by Continuous Flow Method", Analytical Chemistry, Vol. 30, No. 8 (1958) 1387-1390.

Optionally said image-receiving layer contains a non-proteinaceous colloidal binding agent such as polyvinylalcohol and/or poly-N-vinylpyrrolidinone. The polyvinylalcohol is preferably a watersoluble practically completely (at least 90%) hydrolyzed polyvinyl acetate with an average molecular weight in the range of 18,000 to 200,000.

A preferred poly-N-vinylpyrrolidinone has an average molecular weight of about 25,000. When present said binding agents are used preferably in a weight ratio range of 1/10 to ¼ with respect to the colloidal $SiO_2$.

The image receiving layer composition can be coated directly to a hydrophobic resin support, e.g. made of a vinyl chloride polymer, since it has a good adherence thereto in dry as well as in wet state.

The term "vinyl chloride polymer" includes the homopolymer, as well as any copolymer containing at least 50% by weight of vinyl chloride units and including no hydrophilic recurring units.

Vinyl chloride copolymers which may serve as the support may contain one or more of the following comonomers: vinylidene chloride, vinyl acetate, acrylonitrile, styrene, butadiene, chloroprene, dichlorobutadiene, vinyl fluoride, vinylidene fluoride, trifluorochloroethylene, and tetrafluoroethylene.

The vinyl chloride polymer serving as the support may be chlorinated to contain 60-65% by weight of chlorine.

Many properties of polyvinyl chloride and its copolymers are improved by plasticization and their stability can be improved by stabilizers well known to those skilled in the art (see, e.g., F.W.Billmeyer, Textbook of Polymer Chemistry, Interscience Publishers, Inc., New York (1957) p. 311-315)).

The resin support, e.g. vinyl chloride polymer support, may contain pigments or dyes as colouring matter e.g. in an amount up to 5% by weight. An opaque white appearance may be obtained by incorporation of white pigments, e.g. titanium dioxide particles.

A preferred cationic polymeric mordant for use in the image-receiving material according to the present invention contains glycidyl groups that can react with hydroxyl groups of the hydrated silica. Such a mordant is e.g. a basic polyurethane polyurea or polyurea-polyurethane consisting of from 0 to 30 mole % of recurrent units derived from a modifying monomer selected from the group consisting of monofunctional and trifunctional alcohols, amines, and isocyanates and from 70 to 100 moles % of recurrent units of the general formula:

$$(-A-B-)$$

in which segment A is derived from a diol, hydroxy alkylamine or diamine containing at least one tertiary amino group and by removal of two terminal hydrogen atoms corresponds to the general formula:

$$-X_1-(CH_2)_{m1}-\overset{\overset{\displaystyle R^1}{|}}{N}-(CH_2)_{m2}-X_2-$$

wherein:

$R_1$ represents a straight or branched chain alkyl, alkoxyalkyl, aralkyl, a disubstituted aminoalkyl group of the formula:

$$\begin{matrix} R_2 \diagdown \\ \qquad N-(CH_2)_{m3}- \\ R^3 \diagup \end{matrix}$$

or an ethylene or 1,2-propylene group which is attached to $X_1$ or $X_2$ through the second bond with formation of a piperazine ring, $R_2$ and $R_3$ which may be the same or different represent alkyl groups having from 1 to 4 carbon atoms or together represent the atoms required to complete a pyrrolidine, piperidine or morpholine ring, $X_1$ and $X_2$ which may be the same or different, represent —O—, —NH—, —$NR_4$— or a group of the formula —$NR_4$—$(CH_2)_{m4}$—$X_3$— in which:

$R_4$ represents an alkyl group having from 1 to 4 carbon atoms, $X_3$ represents —O—, —NH— or —$NR_4$— and may be the same as or different from $X_1$ and $X_2$, and m1 to m4 represent 2 or 3, and wherein segment A contains up to 40% of the tertiary amino group being quaternized with a quaternizing agent carrying glycidyl groups, and the remainder of the tertiary amino groups being:

(i) quaternized with quaternizing agents absent glycidyl groups, or (ii) neutralized with an acid, and in which segment B is derived from a bis-chloroformate, a diisocyanate or an isocyanate prepolymer having two isocyanate end groups, and corresponds to the formula:

$$-CO-Y-CO-$$

wherein Y represents, —O—$R_5$—O—, —NH—$R_6$—NH— or —NH—$R_6$—NH—CO—O—$R_7$—O—CO—NH—$R_6$—NH—, provided that Y can represent —O$R_5$O— only when $X_1$ or $X_3$ are not —O—, wherein:

$R_5$ represents an alkylene group unsubstituted or substituted by an alkyl group or interrupted by ether oxygen atoms, $R_6$ represents an alkylene group unsubstituted or substituted with alkyl groups, a cycloalkylene group or an arylene group, and $R_7$ represents any divalent group not containing any other Zerewitinoff active group or a group capable of reacting with isocyanate groups.

The preparation of said cationic polymeric mordant proceeds as described in U.S. Pat. No. 4,186,014.

A mordant having particularly good fixing power for anionic dyes is called mordant A and has the following structure (the percentage values are mole %):

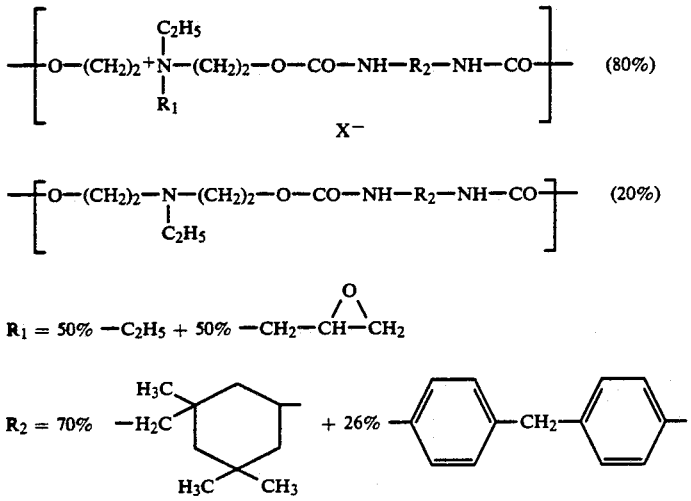

Said mordant is prepared analogously to Example 12 of U.S. Pat. No. 4,186,014.

Generally, good results are obtained when the dye image-receiving layer is about 2 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkylphenols, etc.

The image receiving layer in the dye image receiving material according to the present invention has a high resistance to abrasion and yields very rapidly a touch dry dye image.

The coating of the image-receiving layer composition according to the present invention onto a resin support proceeds preferably for reducing repellence and for allowing a higher coating speed onto a corona discharge pre-treated resin support. Paper supports do not need such pre-treatment.

According to an embodiment of corona discharge treatment the resin support or resin coated paper support, e.g. in sheet or belt form, is led between a grounded conductive roller and corona wires whereto an alternating current (AC) voltage is applied with sufficiently high potential to cause ionization of the air. Preferably the applied peak voltage is in the range of 10 to 20 kV. An AC corona unit is preferred because it does not need the use of a costly rectifier unit and the voltage level can be easily adapted with a transformer. In corona-discharge treatment with an an AC corona unit a frequency range from 10 to 100 kHz is particularly useful. The corona-treatment can be carried out with material in the form of a belt or band at a speed of 10 to 30 m per min while operating the corona unit with a current in the range of 0.4 to 0.6 A over a belt or band width of 25 cm.

The corona-discharge treatment makes it possible to dispense with a solvent treatment for attacking and roughening the surface of the resin support and is less expensive and more refined in its application.

The image-receiving layer can form part of a separate image-receiving material or form an integral combination with the light-sensitive layer(s) of the photographic material.

Where after processing of the photosensitive material the image-receiving layer applied on a support remains associated with a processed silver halide emulsion layer(s) that had been coated thereon, an alkali-permeable light-shielding layer, e.g. containing white pigment particles is applied between the image-receiving layer and the silver halide emulsion layer(s) to mask the negative image with respect to the positive image as described e.g. in the book: "Photographic Silver Halide Diffusion Processes" by André Rott and Edith Weyde—The Focal Press—London—New York (1972) page 141.

After the obtaining of the dye image in the image receiving layer it is advantageous to remove adhering chemicals stemming from e.g. the photographic processing or used in that processing. It has been established experimentally that chemicals such as photographic silver halide developing agents impair the adherence in a lamination step, e.g. as referred to hereinafter, and therefore a cleaning step is preceding preferably the lamination for removing these chemicals. The cleaning proceeds preferably with the aid of a dissolved detergent that diminishes the surface tension in aqueous medium. Any commercial detergent can be used for that purpose. A survey of detergents can be found in the book: "McCutcheon's Detergents & Emulsifiers 1978 North American Edition - McCutcheon Division, MC Publishing Co. 175 Rock Road, Glen Rock, N.J. 07452 U.S.A. Preference is given to anionic and non-ionic surface-active agents containing a polyethyleneoxide chain in their structure. Examples of such agents are described in U.S. Pat. No. 3,663,229.

In order to obtain a less hydrophilic image-receiving layer with better adherence to a hydrophobic resin top coat the dye image containing layer is treated with a siloxane. Preferred siloxane compounds for that purpose are within the scope of the following general formula:

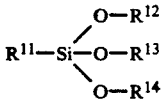

wherein:

$R^{11}$ represents a group containing reactive halogen such as a reactive chlorine atom, an epoxy group or an alpha,beta-ethylenically unsaturated group, representatives of such groups being e.g. the following:

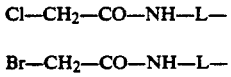

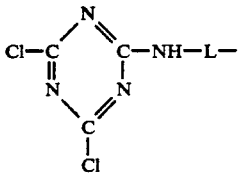

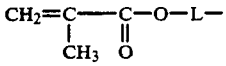

-continued

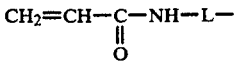

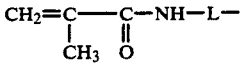

wherein L represents an alkylene group preferably a $C_1$-$C_4$ alkylene group, or $R^{11}$ represents the group:

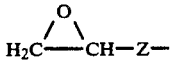

wherein Z is a bivalent hydrocarbon chain including such chain interrupted by oxygen, e.g. is a $—CH_2—O—(CH_2)_3—$ group, or a bivalent hydrocarbon group that is linked at the side of the silicon atom to oxygen, e.g. is a $—CH_2—O—$ group, and each of $R^{12}$, $R^{13}$ and $R^{14}$ (same or different) represents a hydrocarbon group including a substituted hydrocarbon group e.g. methyl and ethyl.

Siloxane compounds according to the above general formula are described in U.S. Pat. No. 3,661,584 and GB-P 1,286,467 as compounds improving the adherence of proteinaceous colloid compositions to glass.

Examples of particularly useful siloxane compounds are listed in the following table 1.

TABLE 1

| | |
|---|---|
| 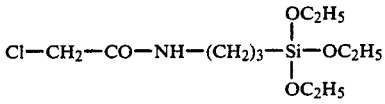 | 1. |
| 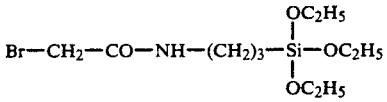 | 2. |
| 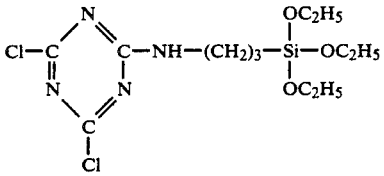 | 3. |
| 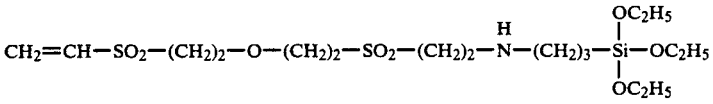 | 4. |
| 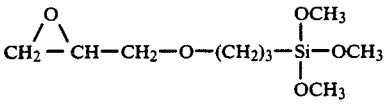 | 5. |
| 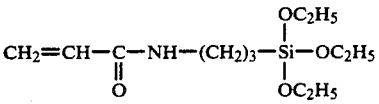 | 6. |
| 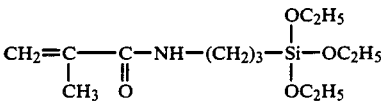 | 7. |

The present image-receiving layer is particularly suited for application in the production of laminar articles comprising a dye image making part of an identification document, also called I.D. card, that contains a colour photograph by lamination sandwiched between a clear plastic protective cover sheet and a rear possibly opaque support sheet.

In view of the widespread use of I.D. cards as security document, e.g. to establish a person's authorization to conduct certain activities (e.g. driver's licence) or to have access to certain areas or to engage in particular commercial actions, it is important that forgery of the I.D. card by alteration of certain of its data and/or photograph is made impossible.

In a particular useful embodiment a laminar article according to the present invention comprises the above defined image receiving layer incorporating a dye image enveloped between a vinyl chloride polymer support and a resin cover sheet fixed to the image receiving layer by lamination using pressure and heat.

According to a preferred embodiment the cover sheet is a polyethylene terephthalate sheet being coated with a resinous melt-adhesive layer, preferably a polyethylene layer.

The lamination of the present image receiving material with a covering hydrophobic resin film sheet material proceeds preferably by heat-sealing between flat steel plates under a pressure of e.g. 10 to 15 kg/cm2 at a temperature in the range of 120 to 150° C., e.g. at 135° C or by using other apparatus available on the market for heat sealing lamination purposes, e.g. hot pressure roller sealer. The cooling of the heat-sealed elements proceeds preferably under pressure to avoid distortion.

The laminate may contain the image receiving layer over the whole area of the support or in a part thereof, e.g. leaving free the edge area as described in U.S. Pat. No. 4,425,421.

According to an embodiment the image receiving layer is coated onto an opaque polyvinyl chloride having a thickness of only 0.050 to 0.300 mm. A sheet of that thickness can receive printed data by means of a mechanical printing process, e.g. offset or intaglio printing. It can receive, before or after being coated with the image receiving layer, or before or after the dye transfer, additional security marks in the form of e.g. a watermark, finger prints, printed patterns known from banc notes, coded information, e.g. binary code information, signature or other printed personal data that may be applied with visibly legible or ultra-violet legible printing inks as described e.g. in GB-P 1,518,946 and U.S. Pat. No. 4,105,333.

Other possibilities to increase security against counterfeiting are the inclusion in the laminate of markings of nacreous pigments, infra-red absorbing markings, magnetic dots or strips and electronic microcircuits either or not combined with ultra-violet radiation absorbing markings hidden from visibility and/or holograms as described e.g. in DE-OS 2 639 952, GB-P 1,502,460 and 1,572,442 and U.S. Pat. No. 3,668,795. The holographic patterns may be obtained in silver halide emulsion layers, normally Lippmann emulsions, especially designed for that purpose and can either or not be combined with a photograph.

According to an embodiment the silver halide emulsion layer for producing the hologram is applied on one side of the transparent cover sheet used in the manufacture of a laminate according to the present invention and laminated to the image receiving layer either or not separated therefrom by a transparent resin intersheet being made of polyethylene or a resin sheet such as a polyvinyl chloride sheet being coated with polyethylene.

When the resin sheet used as support of the laminate has to possess a thickness required for an identification card to be inserted in a slot of an electronic identification apparatus several sheets of matted polyvinyl chloride are stacked and laminated so as to reach a final thickness of e.g. 0.075 to 1 mm. When this lamination to the desired thickness occurs after dye image formation on a relatively thin polyvinyl chloride support, treatment with detergent as referred to hereinbefore to remove adhering chemicals preferably preceeds the lamination. The laminar article contains in that case preferably in the polyvinyl chloride support sheet opacifying titanium dioxide and a suitable plasticizing agent. The support may be provided with an embossed structure.

The following comparative example illustrates the present invention without, however, limiting it thereto.

All parts, ratios and percentages are by weight unless otherwise stated.

EXAMPLE

An opaque polyvinyl chloride sheet having a width of 24 cm and a thickness of 200 μm was treated with an electrical discharge produced by a corona discharge apparatus operated under the following conditions:
film travelling speed: 20 m/min,
electrode spacing to film surface: 2 mm,
corona current: 0.55 A,
AC voltage difference (peak value): 10 kV,
frequency: 30 kHz.

Sample X

The corona-treated surface was coated per $m^2$ with the following aqueous coating composition to form thereon an image receiving layer X for dye diffusion transfer processing:

| | |
|---|---|
| water | 160.9 ml |
| mordant A (20% solution in water) | 266.0 ml |
| water/ethanol (1/1 by volume) at pH 4 | 92 ml |
| aqueous wetting agent mixture W as coating aid | 32.0 ml |
| aqueous hardening agent solution H | 50 ml |
| aqueous acidic colloidal silica/alumina sol Z | 100 ml |

Aqueous wetting agent mixture W contains dissolved in water 12% of saponine and 5% of an iso-nonyl phenoxy wetting agent having following structural formula:

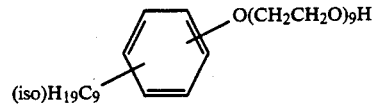

Aqueous hardening agent solution H consists of a 10% solution in water of formaldehyde.

The aqueous acidic colloidal silica/alumina sol Z has a pH of 3.4 and contains 27 g of $SiO_2$ and 3 g of $Al_2O_3$ per 100 ml of water; it was obtained by adding $AlCl_3$ to a basic aqueous silica sol containing colloidal silica with a surface area of 200 $m^2/g$. Said sol P is marketed by Bayer AG, Leverkusen, Bayerwerk (DE) under the registered trade name "KIESELSOL 200 S".

Sample Y

The corona-treated surface was coated per $m^2$ with the following aqueous coating composition to form thereon an image receiving layer X for dye diffusion transfer processing:

| | |
|---|---|
| water | 160.9 ml |
| mordant A (20% solution in water) | 266.0 ml |
| water/ethanol (1/1 by volume) at pH 4 | 92 ml |
| wetting agent mixture W as coating aid | 32.0 ml |
| aqueous hardening agent solution H | 50 ml |
| 10% aqueous solution of poly-N-vinylpyrrolidinone (average molecular weight: 25,000) | 100 ml |
| aqueous acidic colloidal silica/alumina sol Z | 100 ml |

Sample Z

The corona-treated surface was coated per $m^2$ with the following aqueous coating composition to form thereon an image receiving layer Y for dye diffusion transfer processing:

| | |
|---|---|
| water | 160.9 ml |
| mordant A (20% solution in water) | 266.0 ml |
| water/ethanol (1/1 by volume) at pH 4 | 92 ml |
| wetting agent mixture W as coating aid | 32.0 ml |
| aqueous hardening agent solution H | 50 ml |
| 5% aqueous solution of polyvinylalcohol (99-100% hydrolyzed polyvinylacetate) | 50 ml |
| aqueous acidic colloidal silica/alumina sol Z | 100 ml |

Sample N (not within the scope of the invention)

The corona-treated surface was coated per $m^2$ with the following aqueous coating composition to form thereon an image receiving layer X for dye diffusion transfer processing:

| | |
|---|---|
| water | 160.9 ml |
| mordant A (20% solution in water) | 266.0 ml |
| water/ethanol (1/1 by volume) at pH 4 | 92 ml |
| wetting agent mixture W as coating aid | 32.0 ml |
| aqueous hardening agent solution H | 50 ml |
| colloidal silica/alumina sol Z put at pH = 7 | 100 ml |

Said compositions X, Y, Z and N were coated at a wet coverage of 26 m2/1. After coating the samples X, Y, Z and N were dried at 30° C. and processed in combination with a photographic dye diffusion transfer material as described in the Example of U.S. Pat. No. 4,496,645. Said photographic material was exposed with white light through a grey wedge having a constant 0.1 and thereupon contacted for 1 minute with an image receiving material having the composition described hereinafter in a diffusion transfer apparatus COPY-PROOF CP 38 (trade name of Agfa-Gevaert N.V. Belgium) having in its tray following composition:

| | |
|---|---|
| sodium hydroxide | 25 g |
| sodium orthophosphate | 25 g |
| cyclohexane dimethanol | 25 g |
| 2,2'-methylpropylpropane diol | 25 g |
| N-ethylbenzene-pyridinium chloride | 0.5 g |
| distilled water up to | 1000 ml |

After drying the thus treated samples were laminated with a transparent cover sheet being a polypropylene sheet having a thickness of 30 μm coated at one side with a thermoadhesive layer of polyethylene having a thickness of 30 μm. The lamination was carried out between flat steel plates pressing the layers together for 8 minutes using a pressure of 10 kg/cm2 at a temperature of 135° C. Said pressure was maintained during cooling to reach room temperature (20° C.) again.

The laminates with the samples X, Y and Z showed a sealing thus strong that on peeling apart the cover sheet the dye image was destroyed.

The laminate containing sample N showed in wet state a poor adherence of the image receiving layer to its support that could be peeled apart after soaking the laminate in water at 20° C. for 4 h.

We claim:

1. An image receiving material suitable for image production by dye diffusion transfer processing controlled by the development of (an) image-wise exposed silver halide emulsion layer(s), wherein said image receiving material comprises a supported image receiving layer free from gelatin and containing (1) a cationic polymeric mordant, and (2) colloidal silica applied from an aqueous acidic colloidal sol having a pH of not more than 4, and containing hydrated silica in combination with a smaller amount of colloidal alumina, the amount of said colloidal material to said mordant in the image-receiving layer being in a weight ratio range from 1/5 to ½, and silica ($SiO_2$) being present at a coverage of at least 0.5 g per m2.

2. An image-receiving material according to claim 1, wherein said acidic sol has been be prepared by addition of aluminium trihalide to a basic aqueous colloidal silica sol producing that way in situ colloidal alumina forming an intimate mixture with the colloidal silica in an amount from 5 to to 15% by weight of $Al_2O_3$ with respect to $SiO_2$.

3. Image-receiving material according to claim 1, wherein the colloidal silica has a surface area of at least 100 m2 per gram.

4. Image-receiving material according to claim 1, wherein said image-receiving layer contains a non-proteinaceous colloidal binding agent selected from the group consisting of polyvinylalcohol and poly-N-vinylpyrrolidinone.

5. Image-receiving material according to claim 4, wherein the polyvinylalcohol is a watersoluble at least 90% hydrolyzed polyvinyl acetate with an average molecular weight in the range of 18,000 to 200,000 or a poly-N-vinylpyrrolidinone has an average molecular weight of about 25,000.

6. Image-receiving material according to claim 5, wherein said binding agents are used in a weight ratio range of 1/10 to ¼ with respect to the colloidal $SiO_2$.

7. Image-receiving material according to claim 1, wherein said image receiving layer is coated directly to a vinyl chloride polymer support.

8. An image receiving material according to claim 1, wherein the cationic polymeric mordant is a basic polyurethane, polyurea or polyurea-polyurethane consisting of from 0 to 30 mole % of recurrent units derived from a modifying monomer selected from the group consisting of monofunctional and trifunctional alcohols, amines, and isocyanates and from 70 to 100 moles % of recurrent units of the general formula $$(-A-B-)$$

in which segment A is derived from a diol, hydroxy alkylamine or diamine containing at least one tertiary amino group and which by removal of two terminal hydrogen atoms corresponds to the general formula:

$$-X_1-(CH_2)_{m1}-\overset{\overset{\displaystyle R^1}{|}}{N}-(CH_2)_{m2}-X_2-$$

wherein:

$R_1$ represents a straight or branched chain alkyl, alkoxyalkyl, aralkyl, a disubstituted aminoalkyl group of the formula:

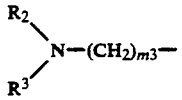

or an ethylene or 1,2-propylene group which is attached to $X_1$ or $X_2$ through the second bond with formation of a piperazine ring, $R_2$ and $R_3$ which may be the same or different represent alkyl groups having from 1 to 4 carbon atoms or together represent the atoms required to complete a pyrrolidine, piperidine or morpholine ring, $X_1$ and $X_2$ which may be the same or different, represent —O—, —NH—, —$NR_4$— or a group of the formula —$NR_4$—$(CH_2)_{m4}$—$X_3$— in which:

$R_4$ represents an alkyl group having from 1 to 4 carbon atoms, $X_3$ represents —O—, —NH— or —$NR_4$— and may be the same as or different from $X_1$ and $X_2$, and m1 to m4 represent 2 or 3, and wherein segment A contains up to 40% of the tertiary amino group being quaternized with a quaternizing agent carrying glycidyl groups, and the remainder of the tertiary amino groups being:

(i) quaternized with quaternizing agents absent glycidyl groups, or (ii) neutralized with an acid, and in which segment B is derived from a bis-chloroformate, a diisocyanate or an isocyanate prepolymer having two isocyanate end groups, and corresponds to the formula:

$$-CO-Y-CO-$$

wherein Y represents, —O—$R_5$—O—, —NH—$R_6$—NH— or —NH—$R_6$—NH—CO—O—$R_7$—O—CO—NH—$R_6$—NH—, provided that Y can represent —$OR_5O$— only when $X_1$ or $X_3$ are not —O—, wherein:

$R_5$ represents an alkylene group unsubstituted or substituted by an alkyl group or interrupted by ether oxygen atoms, $R_6$ represents an alkylene group unsubstituted or substituted with alkyl groups, a cycloalkylene group or an arylene group, and $R_7$ represents any divalent group not containing any other Zerewitinoff active group or a group capable of reacting with isocyanate groups.

9. A laminar article comprising a dye image in an image receiving layer which is enveloped between a vinyl chloride polymer support and a resin cover sheet fixed to the image receiving layer by lamination using pressure and heat, wherein said image receiving layer is free from gelatin and contains (1) a cationic polymeric mordant, and (2) colloidal silica applied from an aqueous acidic colloidal sol having a pH of not more than 4, and containing hydrated silica in combination with a smaller amount of colloidal aiumina, the amount of said colloidal material to said mordant in the image-receiving layer being in a weight ratio range from 1/5 to ½, and silica ($SiO_2$) being present at a coverage of at least 0.5 g per m2.

10. A laminar article according to claim 9, wherein the resin cover sheet is a polyethylene terephthalate sheet coated with a resinous melt-adhesive layer.

11. A laminar article according to claim 10, wherein the resinous melt-adhesive layer is a polyethylene layer.

* * * * *